US006492640B2

(12) United States Patent
Terakura

(10) Patent No.: US 6,492,640 B2
(45) Date of Patent: Dec. 10, 2002

(54) MASS SPECTROMETER WITH IONIZATION DEVICE

(75) Inventor: Ikutaka Terakura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 200 days.

(21) Appl. No.: 09/759,519

(22) Filed: Jan. 16, 2001

(65) Prior Publication Data

US 2001/0017351 A1 Aug. 30, 2001

(30) Foreign Application Priority Data

Feb. 23, 2000 (JP) ..... 2000-045718

(51) Int. Cl.[7] ..... H01J 49/14

(52) U.S. Cl. ..... 250/288; 250/427

(58) Field of Search ..... 250/288, 423 R, 250/427

(56) References Cited

U.S. PATENT DOCUMENTS 3,197,634 A * 7/1965 Watters ..... 250/427
3,648,047 A * 3/1972 Bushman et al. ..... 250/427
4,808,820 A * 2/1989 Blau ..... 250/288

* cited by examiner

*Primary Examiner*—Jack Berman
(74) *Attorney, Agent, or Firm*—Kanesaka & Takaeuchi

(57) ABSTRACT

In an ionization device of a mass spectrometer, an abnormality diagnosis device or control section switches a change-over switch without lighting up a filament, and reads a trap current and a total current supplied to the filament, by current/voltage converting sections. Then, by determining whether the trap current and the total current are zero or more, a trouble due to a contact between the filament or a trap electrode and an ionization chamber is found. When it is determined that a condition is normal, the filament is turned on and the feedback control is operated. Also, the trap current and the total current are respectively read, and in accordance with the values thereof, there is found a deficiency due to a shift of the attachment position of the filament or the trap electrode, or a burnout of the filament.

7 Claims, 4 Drawing Sheets

Fig. 2

| filament | trap current (Ir) | total current (It) | decision |
|---|---|---|---|
| OFF (turn off) | 0 | 0 | normal |
| | 0 | >0 | filament contacts ionization chamber |
| | >0 | 0 | trap electrode contacts ionization chamber |
| | >0 | >0 | both filament and trap electrode contact ionization chamber |
| | values other than the above | | abnormality due to unknown cause |
| ON (light up) | 0 | 0 | cut out of filament |
| | <60μA | >60μA | positional shift of filament and trap electrode |
| | 60μA | >60μA | normal |
| | values other than the above | | abnormality due to unknown cause |

MASS SPECTROMETER WITH IONIZATION DEVICE

BACKGROUND OF THE INVENTION AND RELATED ART STATEMENT

The present invention relates to a mass spectrometer, and more particularly, to a mass spectrometer with an ionization device utilizing an ionization method which uses thermoelectrons, such as electron ionization (EI) or chemical ionization (CI).

In the mass spectrometer, there is used an ionization device using various kinds of ionization methods, such as electron ionization (EI) and chemical ionization (CI). For example, in the EI, a heating current is supplied to a filament to emit thermoelectrons from the filament, and at the same time, an adequate potential difference is produced between the filament and a trap electrode (also called as an electron collector or a target) to provide a kinetic energy to the thermoelectrons. Accordingly, the thermoelectrons emitted from the filament fly toward the trap electrode, and when the thermoelectrons contact sample molecules in an ionization chamber located on the way to the trap electrode, electrons are discharged or beaten out from the sample molecule, so that the sample molecules become positive ions. Normally, the number of the electrons captured at the trap electrode depends on the number of the electrons emitted from the filament. Thus, in order to provide a predetermined value to a trap current which flows owing to the thermoelectrons reaching the trap electrode, the heating current flowing through the filament is subjected to a feedback control, so that an amount of the thermoelectrons generated in the filament becomes approximately constant, resulting in achieving the stable ionization.

In the ionization which utilizes the flow of thermoelectrons, in case the filament and the trap electrode are not adequately attached to predetermined positions with respect to the ionization chamber for operating the ionization, even if a maximum heating current is supplied to the filament, the trap current does not reach the desirable value, so that the control of the heating current as described above can not be made. Therefore, in the conventional mass spectrometer, a value of the trap current is monitored, and in case the trap current does not reach the predetermined value in the condition that the filament is lighted up to operate the feedback control of the heating current, it is determined to be an abnormal condition, s that, for example, an error is displayed.

As the causes of the aforementioned abnormality of the control of the heating current, there can be considered various causes, such as a displacement or shift of the attachment position of the filament or the trap electrode, a contact between the filament or the trap electrode and the ionization chamber, or a burnout or cutout of the filament. However, n the aforementioned conventional mass spectrometer, it can be only detected that the trap current is not normal, and the cause of abnormality can not be specified. Thus, in order to check the kind of abnormality, there is required an operation of returning an inside of a vacuum chamber of the mass spectrometer, which is kept in a vacuum condition, to an atmospheric pressure, and checking the inside thereof by a visual observation. Therefore, the operation for checking the cause of the abnormality and readjustments operation are very cumbersome.

Also, in the aforementioned structure, if the heating current does not flow through the filament, it is impossible to check whether it is abnormal or not. However, in the abnormal condition, if it is tried to supply the heating current to the filament to operate the feedback control, an excessive current flows through the filament or a part of the circuit, possibly resulting in a further breakdown.

The present invention has been made to solve the aforementioned problems, and an object of the invention is to provide a mass spectrometer having an ionization device, which can diagnose a part of abnormalities of a filament or a trap electrode before an electric current is supplied to the filament, and can perform a further detailed diagnoses of an abnormal portion in the condition that the electric current flows through the filament.

Further objects and advantages of the invention will be apparent from the following description of the invention.

SUMMARY OF THE INVENTION

To achieve the above object, the present invention provides a mass spectrometer provided with an ionization device. The ionization device comprises: an ionization chamber disposed in a vacuum chamber; a filament for emitting thermoelectrons for ionizing gas molecules in the ionization chamber; a trap electrode, which accelerates the thermoelectrons by a potential difference between a potential of the filament and that of the trap electrode and captures the thermoelectrons passing through the ionization chamber; first current measuring means for measuring a trap current caused to flow by the thermoelectrons reaching the trap electrode; second current measuring means for measuring a total current as an entire current flowing by the thermoelectrons emitted by the filament; current control means for controlling a heating current flowing through the filament so that either the trap current or the total current has a predetermined value; first abnormality diagnosis means, which allows first and second current measuring means to measure respective current values in a condition that the filament is not energized, and which determines an abnormality based on the measured current values; and second abnormality diagnosis means, which allows the first and second current measuring means to measure respective current values in a condition that a predetermined control is carried out by the current control means, and which determines an abnormality based on the measured current values.

In the ionization device of the mass spectrometer according to the invention, the total current at least includes, in addition to the trap current, a current flowing through the ionization chamber by the contact of the thermoelectrons emitted from the filament with the ionization chamber, instead of the trap electrode. Accordingly, for example, the second cur-rent measuring means measures a current flowing through a bias voltage source which biases the filament to a negative potential with respect to the trap electrode and the ionization chamber, so that the total current can be obtained.

The first abnormality diagnosis means measures the trap current and the total current in the condition that the filament is not energized. In this case, since the thermoelectrons are not generated in the filament, both the trap current and the total current are supposed to be zero. However, since the predetermined potentials different from a potential (normally, a ground potential) of the ionization chamber itself are applied to the filament and the trap electrode, if the filament or the trap electrode contacts the ionization chamber, the trap current or the total current flows. Thus, in case the measured trap current and the total current are not zero, the first abnormality diagnosis means determines that there is an abnormality due to the contact between the trap electrode or the filament and the ionization chamber.

The second abnormality diagnosis means measures the trap current and the total current in the condition that the filament is energized and the heating current is controlled by the current control means. Although there is an upper limit to a heating current which can be supplied to the filament, in the normal condition, the current control means can stabilize the trap current at the substantially predetermined current in the condition that the heating current having the value smaller than the upper limit value is supplied. However, if the attachment position of the filament or the trap electrode is shifted or displaced largely, a proportion that the thermoelectrons emitted from the filament reach the trap electrode is extremely reduced (in other words, many of the thermoelectrons reach the ionization chamber), so that the trap current does not increase even if the heating current is increased. Therefore, even if the heating current of the upper limit value flows through the filament, the trap current does not reach the predetermined value. Thus, in case the measured trap current is smaller than, for example, the predetermined value, the second abnormality diagnosis means determines that there is an abnormality due to the shift of the attachment position of the trap electrode or the filament. Also, in case the filament is burned out or cut out, the heating current does not flow, so that the thermoelectrons are not generated, resulting in that both the trap current and the total current become zero. Thus, in case the trap current and the total current are zero, the second abnormality diagnosis means determines that the filament is burned out or cut out.

If there is a structure such that an existence of abnormality and abnormal portion are warned to a user by a display or sound based on the diagnosis results of the first and second abnormality diagnosis means, the user can recognize the abnormal portion and promptly take the necessary procedure. Also, if there is a structure such that the abnormality diagnosis is carried out by the second abnormality diagnosis means only in case the first abnormality diagnosis means determines that the condition is normal, in case the filament or the trap electrode contacts the ionization chamber, the filament can be prevented from being energized.

According to the mass spectrometer o the invention, the abnormal portion of the ionization device and the cause thereof can be detected in detail, and the results thereof can be informed to the user. Thus, the user can promptly inspect the abnormal portion and an appropriate operation, such as readjustment or replacement, can be started in accordance with necessity. Since these operations can be carried out promptly, an analysis operation becomes efficient. Also, according to the mass spectrometer of the invention, before the filament is lighted up, the abnormality due to the contact between the filament or the trap electrode and the ionization chamber can be detected and informed to the user. In this abnormal condition, if the filament is lighted up, the excessive current might flow through the circuit. However, in the present invention, this abnormality can be found without lighting up the filament, so that the undesirable damage to the circuit due to the excessive current can be avoided.

BRIEF DESCRIPTION OF THE DRAWINGS

FIG. 2 is a table for showing con tents of decisions by abnormal diagnoses in the ionization device of the embodiment;

DETAILED DESCRIPTION OF PREFERRED EMBODIMENTS

Figure 1:
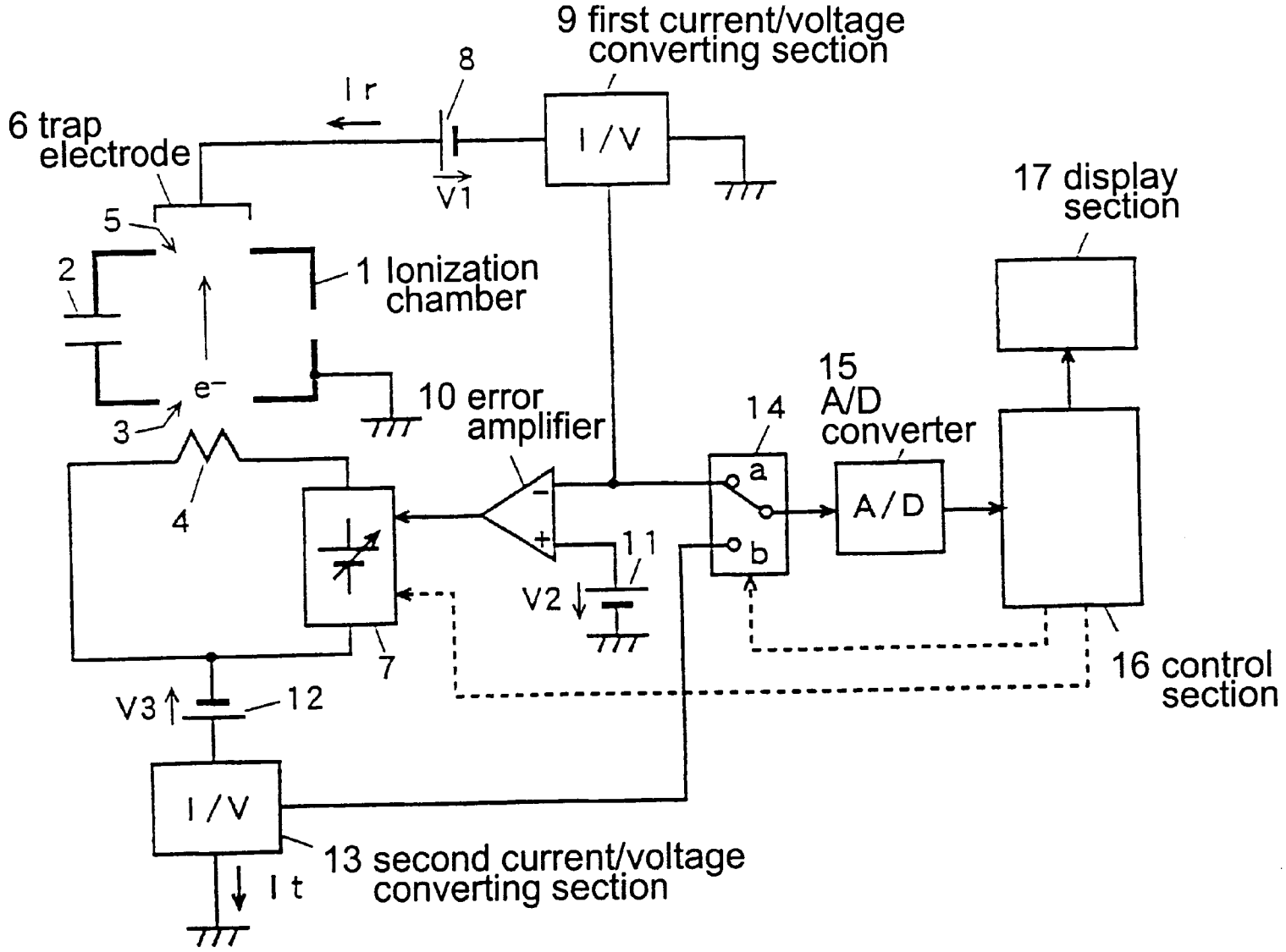
FIG. 1 is a structural diagram of a main section of an ionization device according to an embodiment of a mass spectrometer of the invention.

Hereinafter, embodiments of a mass spectrometer of the invention will be explained with reference to the attached drawings. FIG. 1 is a structural diagram of a main section of an ionization device in a mass spectrometer of the embodiment.

A sample introducing pipe 2 is connected to an ionization chamber 1 disposed in a vacuum condition, and gas sample molecules are introduced from the sample introducing pipe 2 into the ionization chamber 1. A filament 4 for generating thermoelectrons is disposed outside a thermoelectron irradiation hole 3 formed in a wall of the ionization chamber 1, and a trap electrode 6 is disposed outside a thermoelectron outgoing radiation hole 5, which is located to face the thermoelectron irradiation hole 3. A heating current source 7 is connected to the filament 4, and when the heating current is supplied from the heating current source 7 to the filament 4, a temperature of the filament 4 increases and thermoelectrons are emitted. Also, the filament 4 is biased by a third bias voltage source 12 to a negative potential V3 with respect to a ground potential, and is further connected to a second current/voltage converting section 13 for detecting an electric current It (hereinafter referred to as a "total current") flowing through the third bias voltage source 12 and converting the detected current into the voltage.

The trap electrode 6 is biased to a positive potential V1 by a first bias voltage source 8, and is connected to a first current/voltage converting section 9, which detects a trap current Ir flowing through the first bias voltage source 8 and converts the detected current into a voltage. A voltage output of the first current/voltage converting section 9 is inputted into one of input terminals of an error amplifier 10, and is supplied to a terminal a of a change-over switch 14 at the same time. The other input terminal of the error amplifier 10 is biased to a positive potential V2 with respect to the ground potential by a second bias voltage source 11. The error amplifier 10 outputs a voltage corresponding to a difference between the potential V2 and the voltage output of the first current/voltage converting section 9, and supplies the outputted voltage as a control voltage to the heating current source 7. A voltage output of the second current/voltage converting section 13 is supplied to a terminal b of the change-over switch 14, and a voltage selected by the change-over switch 14 is inputted into a control section 16 through an A/D (analog-to-digital) converter 15. The control section 16 is formed of a microcomputer or the like, which includes CPU, and controls the heating current source 7 and the change-over switch 14. Also, the control section 16 processes signals obtained from the A/D converter 15 as explained later, and allows a display section 17 to have a predetermined display.

Next, a control of a flow of the thermoelectrons in the aforementioned structure will be explained. Here, for example, the voltage V1 of the first bias voltage source 8 is 10V; the voltage V2 of the second bias voltage source 11 is 6V; and the voltage V3 of the third bias voltage source 12 is 70V. Also, both conversion sensitivities of the first and second current/voltage converting sections 9 and 13 are 1V/10 $\mu$A, and a desired control value of the trap current Ir is 60 $\mu$A.

When the filament 4 is heated by the heating current supplied from the heating current source 7 to generate the thermoelectrons ($e^{31}$ in FIG. 1), by a potential difference among the filament 4, the ionization chamber 1 and the trap electrode 6, the thermoelectrons are accelerated toward the trap electrode 6. When the thermoelectrons contact the gas sample molecules or atoms which are introduced from the sample introducing pipe 2 into the ionization chamber 1, the electrons are ejected, so that the molecules are ionized. When the thermoelectrons reach the trap electrode 6, the trap current Ir flows by the arrival of the thermoelectrons, and the voltage corresponding to the trap current Ir is generated in the first current/voltage converting section 9 and applied to one of the input terminals of the error amplifier 10.

If the trap current Ir is 60 $\mu$A, the output voltage of the first current/voltage converting section 9 is 6V, so that the potential difference between both the input terminals of the error amplifier 10 is zero. In accordance with this potential difference, the error amplifier 10 outputs the predetermined voltage. If the trap current Ir becomes less than 60 $\mu$A, the output voltage of the first current/voltage converting section 9 is decreased from 6V, and the error amplifier 10 increases the output voltage in accordance therewith. On the contrary, when the trap current is more than 60 $\mu$A and the output voltage of the first current/voltage converting section 9 is increased from 6V, the error amplifier 10 decreases the output voltage in accordance therewith. The heating current source 7 adjusts a current value in accordance with increase or decrease of the voltage described above, so as to reduce the potential difference between both the input terminals of the error amplifier 10. Accordingly, by the feedback control described above, an amount of the thermoelectrons to be generated is controlled so that the trap current Ir has a predetermined value (60 $\mu$A in the above example).

Incidentally, all the thermoelectrons emitted from the filament 4 does not reach the trap electrode 6, and a part of the thermoelectrons collides with the wall surface of the ionization chamber 1. Therefore, the total current It is obtained by adding the electric current, which flows owing to the flow of the thermoelectrons generated from the filament 4 and reaching the ionization chamber 1, to the trap current Ir.

Figure 3:
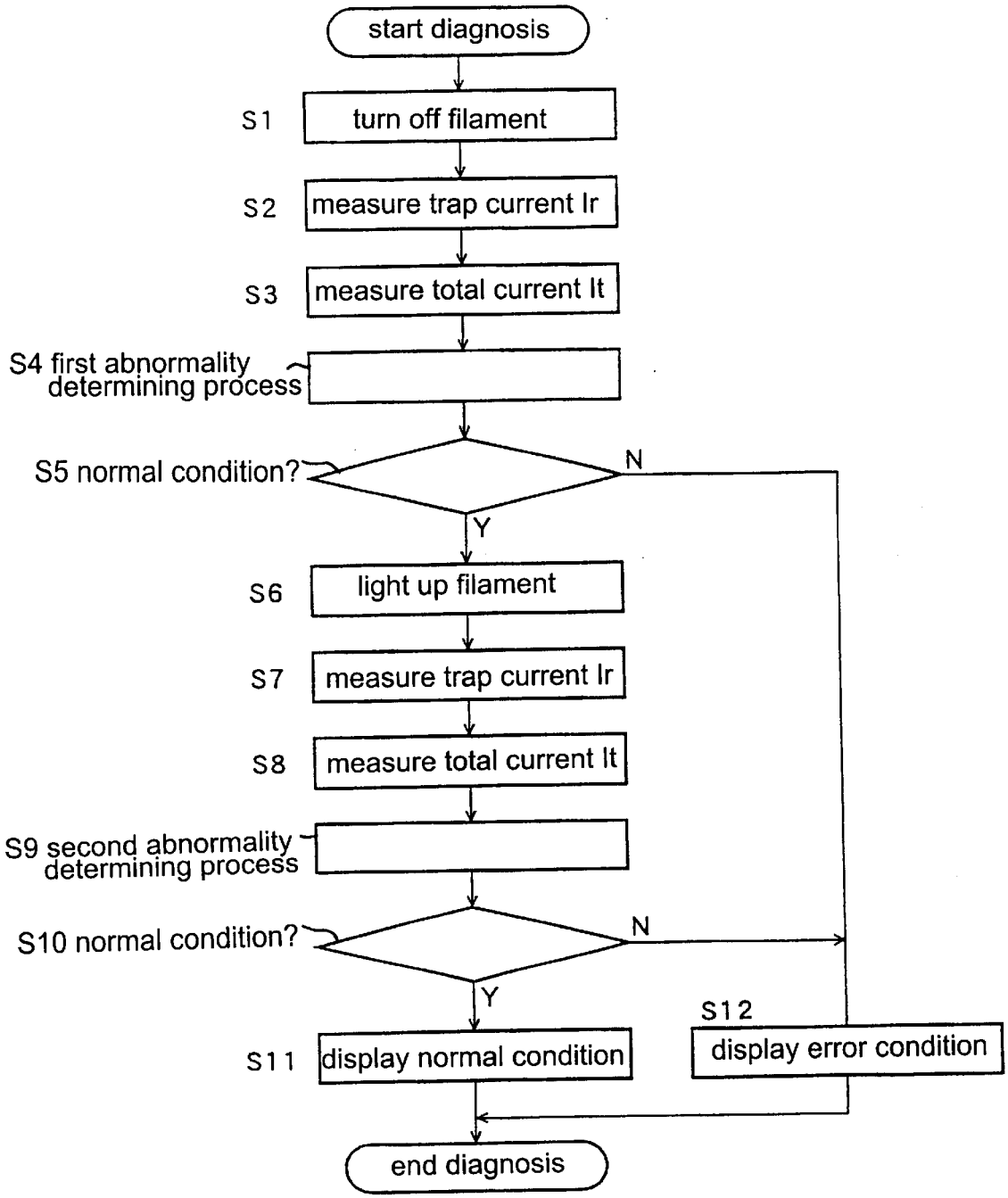
FIG. 3 is a flow chart of an abnormal diagnosis process in the ionization device of the embodiment.

Next, an abnormality diagnosis process in the ionization device according to the embodiment of the invention will be explained with reference to the flow chart in FIG. 3. The abnormality diagnosis process can be carried out by performing a predetermined key operation in the mass spectrometer after assembling adjustment of the ionization device including, for example, the ionization chamber 1, the filament 4, and the trap electrode 6, or the abnormality diagnosis process can be automatically carried out at the time of activating the mass spectrometer.

When the diagnosis is started, first, the control section 16 operates such that in the condition that the filament 4 is turned off, in other words, in the condition that the supply of the heating current from the heating current source 7 to the filament 4 is stopped (step S1), the change-over s witch 14 is turned to the terminal a side to thereby measure the output voltage of the first current/voltage converting section 9, that is, the output voltage corresponding to the trap current Ir (step S2). Then, the control section 16 brings the change-over switch 14 to the terminal b side, and measures the output voltage of the second current/voltage converting section 13, that is, the output voltage corresponding to the total current It (step S3). Then, based on the measured trap current Ir and the total current It (voltages corresponding thereto), the control section 16 carries out a first abnormality determining process (step S4). The abnormality determining process at this point is as follows.

Here, since the heating current is not flowing through the filament 4, naturally, the thermoelectrons are not generated, and the trap current Ir and the total current It should be zero if the condition is normal. However, if there is an abnormality such that the filament 4 contacts the ionization chamber 1, since the filament 4 has a potential lower than that of the ionization chamber 1, an electric current flows from the ionization chamber 1 toward the filament 4. Thus, the total current It becomes larger than zero. On the other hand, if there is an abnormality such that the trap electrode 6 contacts the ionization chamber 1, since the potential of the trap electrode 6 is higher than that of the ionization chamber 1, the electric current flows from the trap electrode 6 toward the ionization chamber 1. As a result, the trap current Ir becomes larger than zero. From the facts described above, as shown in an upper portion of FIG. 2, the measured values of the trap current Ir and the total current It are judged, to thereby determine whether one or both of the filament 4 and the trap electrode 6 contact the ionization chamber 1; whether the cause of the abnormality is unknown; or whether the condition is normal.

In case it is determined that the condition is not normal in the first abnormality determining process ("N" at step S5), the error condition display set in advance is shown in the display 17 in accordance with the abnormality determination result as described above, and the diagnosis process is finished. Therefore, in case the abnormality is found in the first abnormality determining process, the heating current is not supplied to the filament 4.

In case it is determined that the condition is normal in the first abnormality determining process ("Y" at step S5), the control section 16 allows the heating current to be supplied from the heating current source 7 to the filament 4 to thereby light up the filament 4 (step S6). Then, the change-over switch 14 is brought to the terminal a side, and the output voltage of the first current/voltage converting section 9, that is, the output voltage corresponding to the trap current Ir, is measured (step S7). Then, the control section 16 brings the change-over switch 14 to the terminal b side, to thereby measure the output current/voltage converting section 13, that is, the output voltage corresponding to the total current It (step S8). Based on the measured trap current Ir and the total current It (voltages corresponding thereto), the control section 16 carries out a second abnormality determining process (step S9). The abnormality determining process at this point is as follows.

In this case, the thermoelectrons are generated at the filament 4, and the feedback control of the heating current is carried out such that the trap current Ir becomes the predetermined value as described above. Therefore, in case of a normal condition, the trap current Ir becomes 60 $\mu$A or the value extremely close thereto, and the total current It should be larger than 60 $\mu$A since the current, which flows owing to the thermoelectrons reaching the ionization chamber 1, is add ed to the trap current Ir. Nevertheless, in case a proportion of the thermoelectrons reaching the trap electrode 6 among the thermoelectrons generated at the filament 4 is quite low since an attachment position of the filament 4 or the trap electrode 6 is not appropriate, (in other words, in case a proportion of the thermoelectrons reaching the ionization chamber 1 is high), the error amplifier 10 increases the output voltage so as to increase the trap current Ir to the desired value. However, even if the heating current source 7 supplies the maximum heating current to the filament 4, the trap current Ir does not reach the desired value. Therefore, the trap current Ir becomes smaller than 60 $\mu$A which is the desired value. Furthermore, in case the heating current itself does not flow due to the cutout of the filament 4, both the trap current Ir and the total current It become zero.

From the foregoing, as shown in a lower portion of FIG. 2, the control section 16 judges the measured trap current Ir and the total current It, and determines whether the positional shift of the filament 4 or the trap electrode 6 occurs; whether the filament is cut out; whether a cause of the abnormality is unknown; or whether the condition is normal. Actually, even though the feedback control of the flow of thermoelectrons is normal, the trap current Ir does not always become 60 $\mu$A due to various error factors. Thus, in case the trap current Ir is in a predetermined allowance range with respect to 60 $\mu$A and the total current It is larger than a value, which is larger than 60 $\mu$A for a predetermined value, the condition is determined as normal.

In case it is determined that the condition is not normal in the second abnormality determining process ("N" at step S10), in accordance with the abnormality decision result described above, an error condition display set in advance is shown in the display section 17 (step S12), and the diagnosis process is finished. On the other hand, in case it is determined that the condition is normal ("Y" at step S10), a display for showing the normal condition is shown at the display section 17 (step S11), and the diagnosis process is finished. Needless to say, appropriate modified examples, such as an example that nothing is displayed in case of the normal condition, can be made easily.

As described above, in the ionization device according to the embodiment of the invention, it is possible to diagnose whether the filament 4 and the trap electrode 6 contact the ionization chamber 1 in the condition that the filament 4 is not energized. Also, when it is determined to be normal in this case, the filament 4 is energized, and it can be determined whether there are positional shifts of the filament 4 and the trap electrode 6, or whether there is a cutout of the filament 4. Therefore, it can be prevented to energize the filament 4 when the filament 4 or the trap electrode 4 contacts the ionization chamber 1, and there is no possibility that the undesirable excessive current flows through the circuit, so that the unnecessary damage can be prevented. Also, unlike the conventional mass spectrometer, since the cause of the trouble, that is, the abnormal portion, is concretely indicated to a user, the indicated portion can be inspected, and an appropriate procedure, such as readjustment or replacement, can be promptly made.

Incidentally, the aforementioned embodiment is one example, and can be adequately modified and changed within the gist of the invention.

For example, although the aforementioned embodiment is the ionization device using the electron ionization method, the present invention can be applied to a general ionization device provided with the filament for generating thermoelectrons and the trap electrode for capturing the thermoelectrons, and for example, it can be applied to an ionization device using a chemical ionization method. However, in the ionization device by the chemical ionization method, since a sealing performance of the ionization chamber 1 is generally high, a percentage of the thermoelectrons passing through the ionization chamber 1 and reaching the trap electrode 6 is originally small. Therefore, the feedback control using the trap current as described above is difficult, so that the feedback control using the total current is operated instead.

Figure 4:
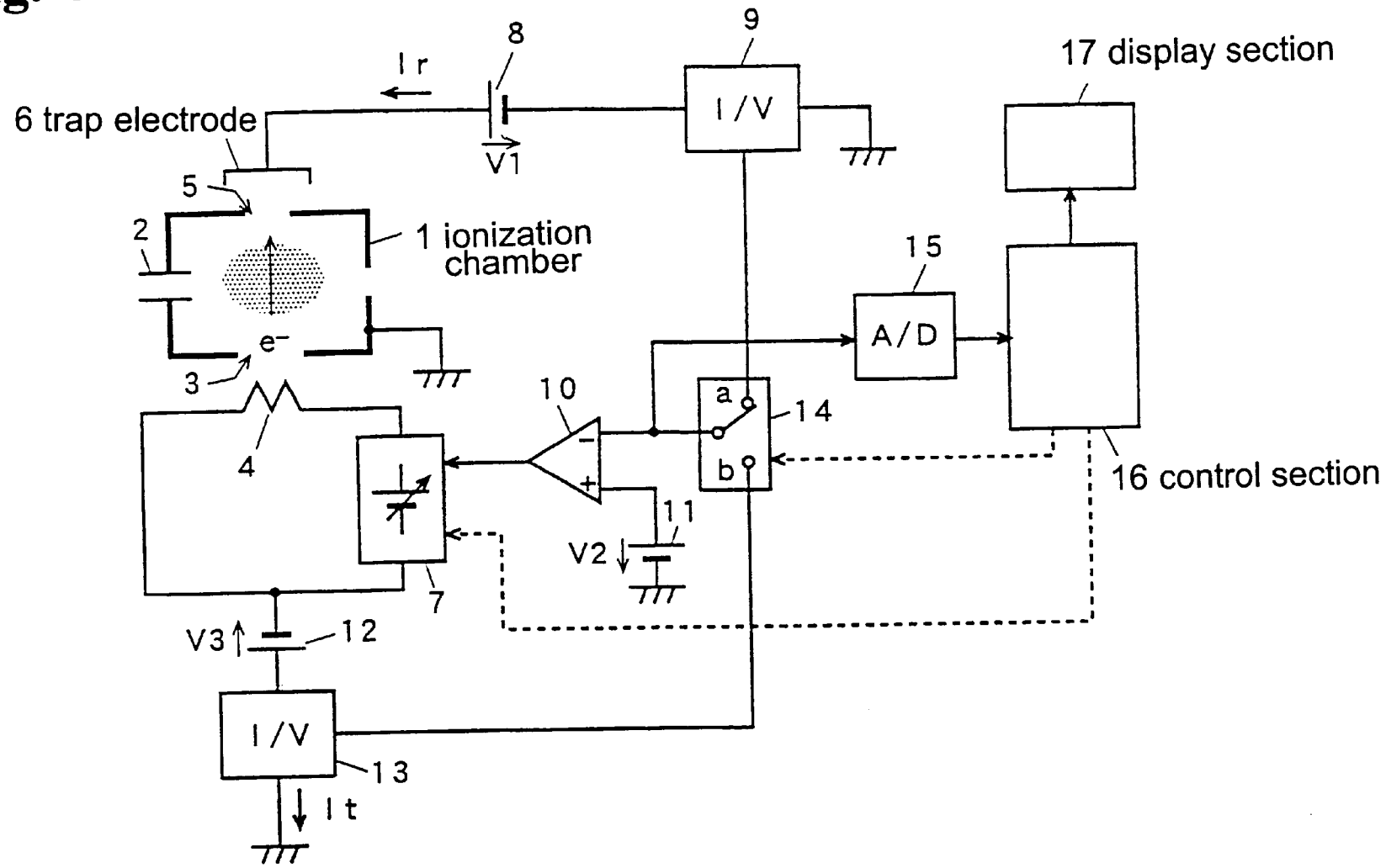
FIG. 4 is a structural diagram of a main section of an ionization device according to another embodiment of the mass spectrometer of the invention.

FIG. 4 shows a modified example, wherein the structure of the ionization device shown in FIG. 1 is modified to be suitable for the chemical ionization device. In this structure, output voltages of the first current/voltage converting section 9 and the second current/voltage converting section 13 are selected by the change-over switch 14, and inputted into one of the input terminals of the error amplifier 10 and the A/D converter 15. Thus, in case the total current It is measured in the condition that the heating current is supplied to the filament 4, the heating current is subjected to the feedback control such that the total current It becomes the predetermined value, resulting in that the abnormality diagnosis as in the aforementioned embodiment of FIG. 1 can be carried out.

While the invention has been explained with reference to the specific embodiments of the invention, the explanation is illustrative and the invention is limited only by the appended claims.

What is claimed is:

1. A mass spectrometer provided with an ionization device, wherein the ionization device comprises:

an ionization chamber, a filament situated near the ionization chamber for emitting thermoelectrons for ionizing molecules in the ionization chamber, a trap electrode situated near the ionization chamber at a side opposite to the filament for accelerating the thermoelectrons by a potential difference between a potential of the filament and that of the trap electrode, said trap electrode capturing the thermoelectrons passing through the ionization chamber, first current measuring means connected to the trap electrode for measuring a trap current flowing by the thermoelectrons reaching the trap electrode, second current measuring means connected to the filament for measuring a total current flowing by the thermoelectrons emitted by the filament, current control means connected to the filament for controlling a heating current flowing through the filament so that one of the trap current and the total current becomes a predetermined value, and abnormality diagnosis means connected to the first and second current measuring means and the filament, said abnormality diagnosis means measuring current values of the first and second current measuring means in conditions that the filament is energized and not energized to determine abnormality based on the measured current values.

2. A mass spectrometer according to claim 1, wherein said abnormality diagnosis means includes first diagnosis means for allowing the first and second current measuring means to measure the respective current values in the condition that the filament is not energized to determine an abnormality based on the measured current values in the condition that the filament is not energized, and second abnormality diagnosis means for allowing the first and second current measuring means to measure the respective current values in the condition that a predetermined control is carried out by the current control means, said second abnormality diagnosis means determining an abnormality based on the measured current values in the condition that the predetermined control is carried out.

3. A mass spectrometer according to claim 2, wherein said current control means is connected to the first current measuring means so that the trap current becomes the predetermined value by changing the current to the filament.

4. A mass spectrometer according to claim 3, wherein said first current measuring means has a first bias electric source, and the second current measuring means has a second bias electric source with a value different from that of the first bias electric source.

5. A mass spectrometer according to claim 4, further comprising a switch connected to the control section to measure the trap current and the total current sequentially.

6. A mass spectrometer according to claim 5, further comprising a display section connected to the abnormality diagnosis means for displaying results of the abnormality diagnosis means.

7. A mass spectrometer according to claim 6, wherein said ionization chamber is disposed in a vacuum chamber.

* * * * *